US007470154B2

(12) United States Patent
Sato

(10) Patent No.: US 7,470,154 B2
(45) Date of Patent: Dec. 30, 2008

(54) PLUG

(75) Inventor: Junichi Sato, Fussa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/844,927

(22) Filed: Aug. 24, 2007

(65) Prior Publication Data

US 2008/0102710 A1 May 1, 2008

(30) Foreign Application Priority Data

Oct. 27, 2006 (JP) ..... 2006-292731

(51) Int. Cl.
*H01R 13/04* (2006.01)

(52) U.S. Cl. ..... 439/693

(58) Field of Classification Search ..... 439/692, 439/693, 933, 675, 181
See application file for complete search history.

(56) References Cited

U.S. PATENT DOCUMENTS 616,501 A * 12/1898 Stanford ..... 424/568
3,885,849 A * 5/1975 Bailey et al. ..... 439/518
4,012,103 A * 3/1977 Lunquist ..... 439/181
4,310,213 A * 1/1982 Fetterolf et al. ..... 439/320
4,316,647 A * 2/1982 Bailey et al. ..... 439/354
4,464,540 A * 8/1984 Reeder ..... 174/359
4,493,525 A * 1/1985 Hall et al. ..... 439/610
4,611,878 A * 9/1986 Hall et al. ..... 439/610
4,634,208 A * 1/1987 Hall et al. ..... 439/610
4,723,916 A * 2/1988 Fusselman et al. ..... 439/92
4,737,124 A * 4/1988 Ezure et al. ..... 439/610
4,747,783 A * 5/1988 Bellamy et al. ..... 439/59
RE32,864 E * 2/1989 Ezure ..... 439/152
4,925,394 A * 5/1990 Hayashi et al. ..... 439/86
4,960,388 A * 10/1990 Frantz et al. ..... 439/404
4,960,389 A * 10/1990 Frantz et al. ..... 439/404
4,969,839 A * 11/1990 Nilsson ..... 439/395
4,985,002 A * 1/1991 Maisch et al. ..... 439/607
5,120,268 A * 6/1992 Gerrans ..... 439/736
5,417,585 A * 5/1995 Morin et al. ..... 439/488
5,641,307 A * 6/1997 Gerrans ..... 439/606
5,885,108 A * 3/1999 Gerrans, Jr. ..... 439/606
6,113,436 A 9/2000 Kuwahara et al.
6,537,091 B2 * 3/2003 Hirai et al. ..... 439/181
6,623,288 B2 * 9/2003 Sakiyama et al. ..... 439/181
6,855,888 B2 * 2/2005 Jacke ..... 174/84 R
6,857,887 B1 * 2/2005 Belson et al. ..... 439/181
6,860,746 B2 * 3/2005 Ota et al. ..... 439/181
6,918,800 B2 * 7/2005 Ota et al. ..... 439/886
6,942,516 B2 * 9/2005 Shimoyama et al. ..... 439/352

(Continued)

FOREIGN PATENT DOCUMENTS

JP 06-045031 2/1994

(Continued)

*Primary Examiner*—Ross N Gushi
(74) *Attorney, Agent, or Firm*—Blakely, Sokoloff, Taylor & Zafman LLP

(57) ABSTRACT

According to one embodiment, a plug includes four terminals arranged around a core shaft at substantially equal intervals, a housing that supports proximal ends of the four terminals, and a cylindrical cover fixed to the housing such as to surround the four terminals. The four terminals include two power terminals and two ground terminals, and at least the two power terminals have insulating coating layers respectively at their distal end portions.

4 Claims, 2 Drawing Sheets

U.S. PATENT DOCUMENTS

| | | | | |
|---|---|---|---|---|
| 6,994,579 | B2 * | 2/2006 | Yokoigawa et al. | 439/320 |
| 7,101,223 | B2 * | 9/2006 | Neumann et al. | 439/585 |
| 2001/0024895 | A1 * | 9/2001 | Sakiyama et al. | 439/181 |
| 2002/0064986 | A1 * | 5/2002 | Hirai et al. | 439/181 |
| 2002/0072275 | A1 * | 6/2002 | Arai | 439/680 |
| 2003/0194893 | A1 * | 10/2003 | Ota et al. | 439/181 |

FOREIGN PATENT DOCUMENTS

| | | |
|---|---|---|
| JP | 2002-373729 | 12/2002 |

* cited by examiner

PLUG

CROSS-REFERENCE TO RELATED APPLICATIONS

This application is based upon and claims the benefit of priority from Japanese Patent Application No. 2006-292731, filed Oct. 27, 2006, the entire contents of which are incorporated herein by reference.

BACKGROUND

1. Field

One embodiment of the invention relates to a plug used to supply power to electronic devices.

2. Description of the Related Art

For example, Jpn. Pat. Appln. KOKAI Publication No. 2002-373729 discloses a plug used for a charger-use cable for an electrically powered wheelchair. The plug includes a rod-like core conductor, a cylindrical outer conductor that surrounds the core conductor, an insulation cylinder provided between the core conductor and outer conductor, and an insulation housing that supports the proximal ends of these members. The core conductor includes a neck portion that has a narrow diameter in the vicinity of the distal end portion and an insulation piece that engages with the neck portion and covers the distal end portion. The insulation cylinder extends outwards such as to cover the distal end portion of the outer conductor.

In the plug, the distal end portion of the core conductor and the distal end portion of the outer conductor are each covered with an insulating material. With this structure, the user is protected from electrical shocks by touching these distal end portions.

However, after repetitious plug-in and plug-out, it is highly possible that the insulation piece that covers the distal end of the core conductor may be deformed in the conventional case. Due to the deformation, the insulation piece may be detached from the neck portion, and thus there is conventionally a drawback of the durability of the plug. Further, when forming the neck portion, it is necessary to provide a separate step of processing the core conductor, and thus the manufacturing process for the plug is complicated. Furthermore, if the insulation piece is made of a resin, not only a forming mold exclusively used for the preparation of the insulation piece is required, but also the number of parts required is increased, which causes an increase in the production cost.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a plug includes four terminals arranged around a core shaft at substantially equal intervals, a housing that supports proximal ends of the four terminals, and a cylindrical cover fixed to the housing such as to surround the four terminals. The four terminals include two power terminals and two ground terminals, and at least the two power terminals have insulating coating layers respectively at their distal end portions.

An embodiment of the electronic device in which the plug of the present invention is applied will now be described with reference to FIGS. 1 to 3.

Figure 1:
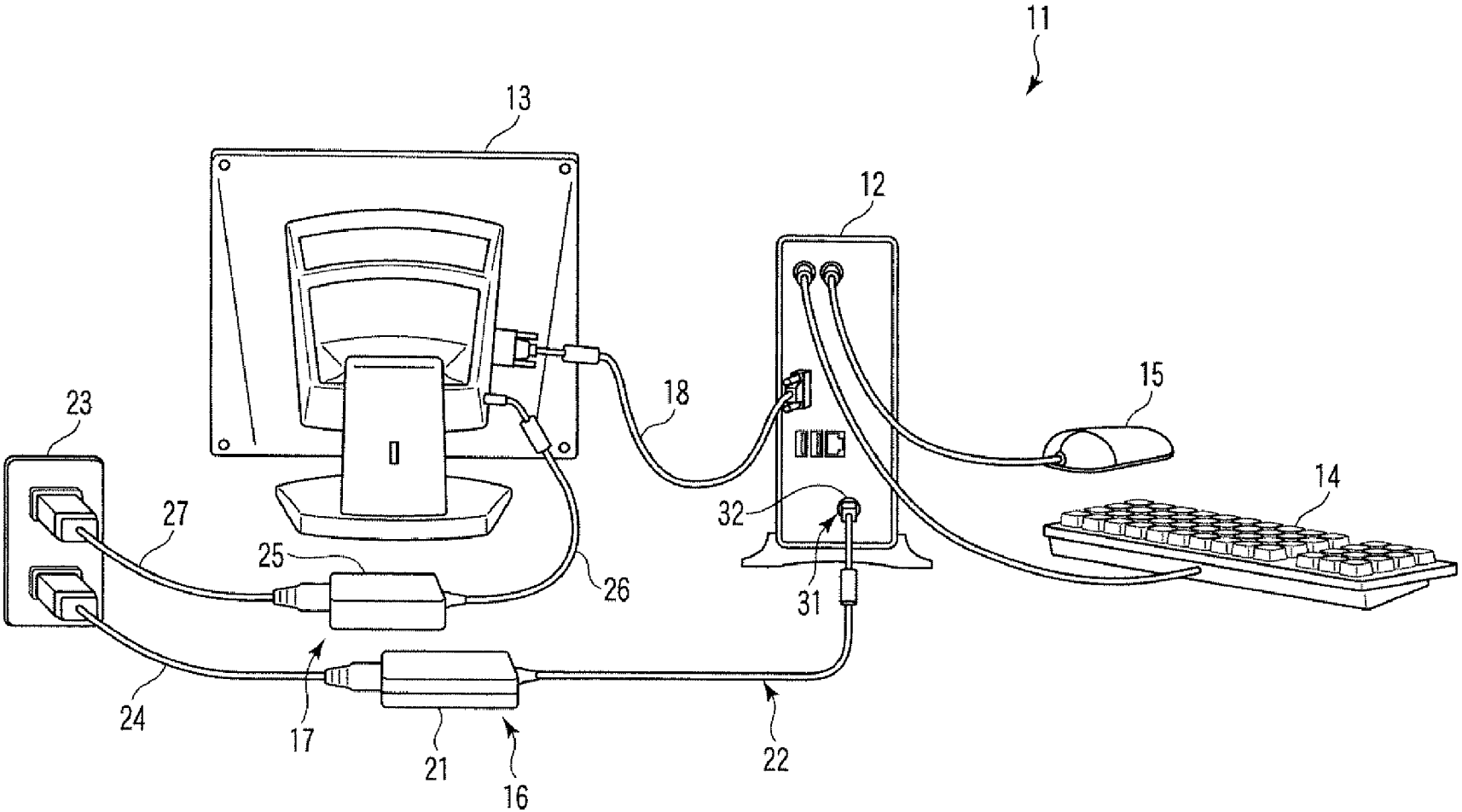
FIG. 1 is an exemplary perspective view of a desktop personal computer, which is an example of the electronic device according to this embodiment.

As shown in FIG. 1, a desktop computer 11, which is an example of the electronic device, includes a main body 12, a display 13, a keyboard 14, a mouse 15, a first power device 16 connected to the main body 12, a second power device 17 connected to the display 13, and a cable 18 that connects the main body 12 and the display 13 to each other.

The first power device 16 includes a first AC adaptor 21, a first cord 22 that connects the first AC adaptor 21 to the main body 12, and a second cord 24 that connects the first AC adaptor 21 to a wall outlet 23. The second power device 17 includes a second AC adaptor 25, a third cord 26 that connects the second AC adaptor 25 to the display 13, and a fourth cord 27 that connects the second AC adaptor 25 to a wall outlet 23. The first cord 22 includes a plug 31 at a section serving as a connection portion to the main body 12, whereas the main body 12 includes a connector 32 at its back in which the plug 31 is inserted.

Figure 2:
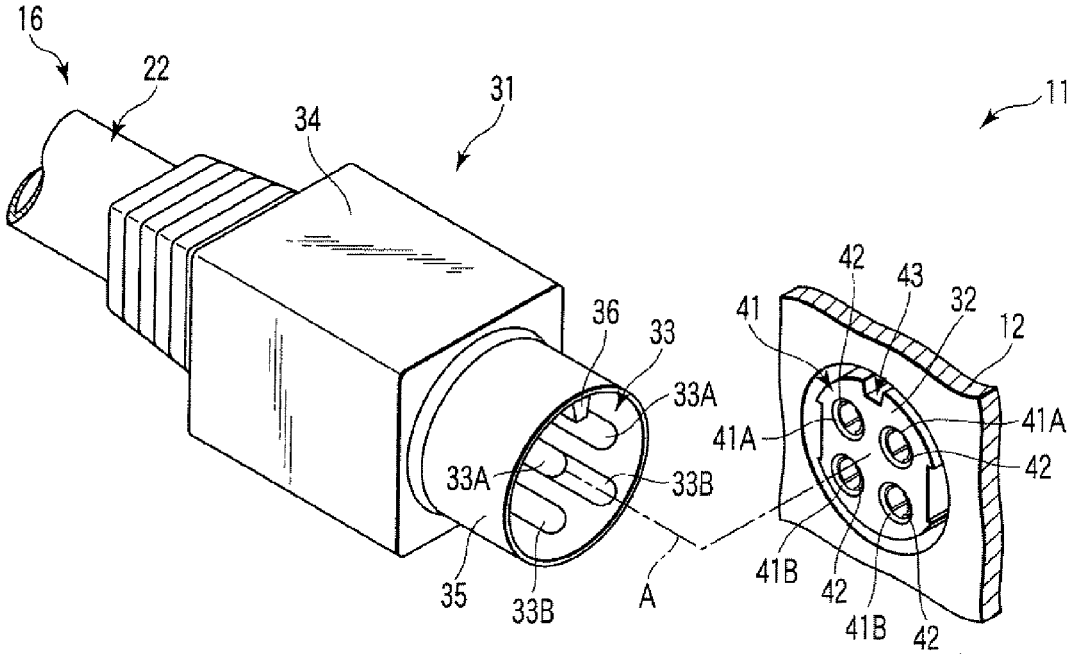
FIG. 2 is an exemplary perspective view of a plug and connector of the desktop personal computer shown in FIG. 1.

As shown in FIG. 2, the plug 31 has four terminals 33, a housing 34 that supports distal ends of the four terminals 33, a cylindrical cover 35 fixed to the housing 34 such as to surround the four terminals 33, and an aligning pin 36 provided in the cover 35. The four terminals 33 arranged around a central axis A of the plug 31 substantially at equal intervals. The four terminals 33 each have a length of, for example, 7 mm to 8 mm and a rod-shape. The four terminals 33 include two power terminals 33A that supply power to the main body 12 and two ground terminals 33B that grounds the main body 12.

The connector 32 of the main body 12 includes four plug-in holes 41 in which the four terminals 33 are plugged respectively, connection terminals 42 provided inside the plug-in holes 41, respectively, and a groove portion 43 in which the aligning pin 36 is inserted. The four plug-in holes 41 includes two first plug-in holes 41A in which the power terminals 33A are plugged respectively, and two second plug-in holes 41B to which the ground terminals 33B are plugged respectively. The connection terminals 42 are each formed into a cylindrical shape having a pair of slits formed in its upper and lower sections. As the aligning pin 36 of the plug 31 is fit into the groove portion 43 of the connector 32, the plug 31 is inserted to the connector 32 at an appropriate angle. As the terminals 33 of the plug 31 are inserted to the plug-in holes 41 of the connector 32, the terminals 33 are respectively connected electrically connected to the connection terminals 42 of the plug-in holes 41.

Figure 3:
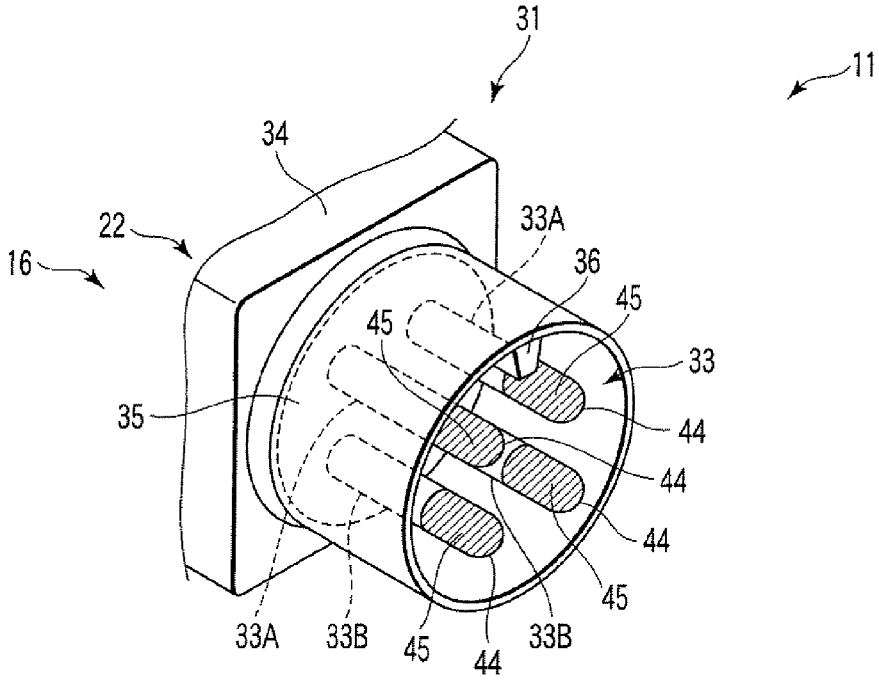
FIG. 3 is an exemplary enlarged view of the plug shown in FIG. 2.

As shown in FIG. 3, the four terminals 33 each have an insulating coating layer 45 at its distal end portion 44. The coating layer 45 is formed to have a length of, for example, ⅓ of the entire length of the terminal 33. In this embodiment, the coating layer 45 is formed to have a length of ⅓ of the entire length of the terminal 33 from the distal end portion 44. However, the length is not limited to this, but it may be an arbitral length as long as it does not exceeds ⅓ of the entire length of the terminal 33. Therefore, the coating layer 45 may have a length of, for example, ¼ of the entire length of the terminal 33.

Further, the coating layer 45 can exhibit its advantageous effect even if it is formed to have a length of about ¼ to ⅛ of the entire length of the terminal 33, that is, 1 mm to 2 mm. However, if the length of the coating layer 45 is shorter than this as compared to the entire length of the terminal 33, a sufficiently insulation effect cannot be obtained. Therefore, it is preferable that the coating layer 45 should be formed to have a length of ⅓ or shorter but ⅛ or longer of the entire length of the terminal 33. Further, in this embodiment, the coating layer 45 is provided for all of the four terminals 33; however it suffices if the coating layer 45 is provided on the distal end portions 44 of at least two power terminals 33A.

Each of the coating layers 45 is formed by coating the distal end portion 44 of the terminal 33 with an insulating fluoropolymer such as Teflon®. As compared to other type of reins, the fluoropolymer is superior in terms of slipping property, wear resistance, heat resistance, etc. With this resin, it is possible form a coating layer 45 that can endure repetitious plug-in and plug-out operations with respect to the plug 31.

Subsequently, the method of manufacturing the plug 31 of this embodiment will now be described. In the plug 31 of this embodiment, an insulating resin is formed for a proximal end portion located on an opposite side to the distal end portion 44 of the terminal 33, and thus the housing 34 is formed. After the formation of the housing 34, the four terminals 33 can be supported collectively via the housing 34. While maintaining this state, the coating layer 45 is formed for each of the terminals 33 before mounting the cylindrical cover 35 onto the housing 34.

The coating layer 45 can be formed by applying the fluoropolymer onto the distal end portion 44 of each terminal 33. More specifically, in order to form the coating layer 45 only in the section of the distal end portion 44 of each terminal 33, the proximal end portion of the terminal 33 is in advance masked with a masking tape which is not shown in the figure. While maintaining this state, the fluoropolymer is applied onto each terminal 33 by, for example, powder coating technique, and thus the coating layer 45 is formed. After that, the masking tape is removed, and a cylindrical cover 35 is mounted onto the housing 34. With the above-described process, the plug 31 in which the coating layer 45 is formed on the distal end portion 44 of each of the terminals 33 can be manufactured.

The above is an embodiment of the electronic device in which the plug 31 is applied. According to this embodiment, each of the four terminals 33 of the plug 31 has the insulating coating layer 45 at its distal end portion 44. With this structure, even if the user accidentally bring a terminal 33 of the plug 31 into contact with some other conducting member such as the head portion of a screw while the first power device 16 being connected to the wall outlet 23, the conduction of the terminal 33 and the conducting member can be prevented. In this manner, no electric current flows between the terminal 33 and the conducting member, and therefore it is possible to prevent the breakdown of the first power device 16 caused by the current flow.

Meanwhile, if the user mistakenly tries to insert the plug 31 to the connector 32 of the main body 12 in a wrong direction, for example, being rotated by 90° from the appropriate direction, the aligning pin 36 and groove portion 43 operate to inhibit the plug 31 from being deeply inserted to the connector 32. Nevertheless, in some cases, the distal end portion 44 of a power terminal 33A is brought into contact with the connection terminal 42 of the second plug-in hole 41B for the ground terminal 33B. Here, if a conventional type of terminal without a coating layer is used, the terminal of the plug is brought into contact with the connection terminal of the second plug-in hole, causing short-circuiting. As a result, the main body 12 may be broken down. However, in the plug 31 of this embodiment, the coating layer 45 is provided on the distal end portion 44 of the terminal 33. With this structure, even if the terminal 33 of the plug 31 and the connection terminal 42 of the second plug-in hole 41B are brought into contact with each other in wrong combination, the short-circuiting between these members can be prevented.

Further, when the insulating coating layer 45 is formed on the distal end portions 44 of at least two power terminals 33A of the four terminals 33, it is possible to prevent the breakdown of the first power device 16 or the breakdown of the main body 12. Therefore, when the coating layer 45 is formed only on the two power terminals 33A, the manufacturing process can be further simplified, and the amount of the material for forming the coating layers can be cut down.

The coating layer 45 is formed by applying an insulating rein on the distal end portion 44. With this structure, the distal end portion 44 of each terminal 33 can be covered with an insulating material in a simple way and at a low cost as compared to the case where insulating pieces are formed by molding. Further, in the conventional case where an insulating piece is applied onto the distal end portion 44 of each terminal 33, once the insulating piece is deformed and detached from it, the terminal 33 can no longer exhibit the insulating property. By contrast, the coating layer 45 is formed by coating as in this embodiment, a part of the coating layer 45 may be peeled off due to the wear caused by repetitious plug-in and plug-out operations, but the rest of the portion of the coating layer 45 remains on the distal end portion 45. In this manner, it is possible to prevent such an accident that the insulating property is not at all exhibited from a certain point such as when the insulating piece is deformed and detached therefrom in the conventional type of plug, but the insulating property of the coating layer 45 can be gradually deteriorated. As a result, the durability of the insulating property of the terminal 33 can be improved.

The coating layer 45 is formed to have a length of ⅓ or less but ⅛ or more of the entire length of the terminal 33. When the length of the coating layer 45 is longer, the insulating property is increased accordingly, but at the same time, the conductivity between the terminal 33 of the plug 31 and the connection terminal 42 of the connector 32 is decreased. With the above-specified range, the size of the coating layer 45 falls in an appropriate range, and therefore it is possible to prevent the decrease in the conductivity between the terminal 33 of the plug 31 and the connection terminal 42 of the connector 32. Further, the amount of the material used for forming the coating layers 45 can be lessened.

The coating layers 45 are each formed of a fluoropolymer. With this structure, the coating layers 45 are able to exhibit a slipping property, wear resistance and heat resistance, which are unique properties to fluoropolymer. Thus, the durability of the coating layer 45 can be improved as compared to the case where an insulating piece is mounted onto the distal end portion 44 of the terminal 33.

The plug 31 of this embodiment can be applicable not only to desktop personal computers as described above, but also some other electronic devices, for example, mobile information terminals. Further, it is only natural that the plug 31 can be remodeled into various versions as long as the essence of the invention remains within its scope. For example, in this embodiment, the coating layer 45 is provided for the terminals 33 of the plug 31, but it is alternatively possible to provide an insulating coating layer on the inner circumferential surface of the connection terminal 42 of the connector 32 of the main body 12 at a section facing the outside, to obtain a similar advantageous effect to the above.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A plug comprising:

four terminals arranged around a core shaft at substantially equal intervals;

a housing that supports proximal ends of the four terminals; and a cylindrical cover fixed to the housing such as to surround the four terminals;

wherein the four terminals include two power terminals and two ground terminals, and at least the two power terminals of the four terminals have insulating coating layers respectively at their distal end portions.

2. The plug according to claim 1, wherein the coating layers are each formed by applying an insulating resin on the respective distal end portion.

3. The plug according to claim 2, wherein the coating layers are formed to have a length of ⅓ or less but ⅛ or more of an entire length of the terminals.

4. The plug according to claim 2, wherein the coating layers are formed of a fluoropolymer.

* * * * *